US010940979B1

(12) United States Patent
Gillespie

(10) Patent No.: US 10,940,979 B1
(45) Date of Patent: Mar. 9, 2021

(54) DISPOSABLE BEVERAGE LID

(71) Applicant: Thomas Gillespie, Cleveland, OH (US)

(72) Inventor: Thomas Gillespie, Cleveland, OH (US)

(73) Assignee: GETCO, Inc., Cleveland, OH (US)

( * ) Notice: Subject to any disclaimer, the term of this patent is extended or adjusted under 35 U.S.C. 154(b) by 127 days.

(21) Appl. No.: 16/168,277

(22) Filed: Oct. 23, 2018

Related U.S. Application Data

(60) Provisional application No. 62/575,661, filed on Oct. 23, 2017.

(51) Int. Cl.
*B65D 43/02* (2006.01)
*B65D 47/10* (2006.01)
*B65D 43/06* (2006.01)

(52) U.S. Cl.
CPC ..... *B65D 43/0212* (2013.01); *B65D 43/0231* (2013.01); *B65D 43/06* (2013.01); *B65D 47/10* (2013.01); *B65D 2547/063* (2013.01)

(58) Field of Classification Search
CPC ..... B65D 2543/00092; B65D 2543/00296; B65D 43/0212; B65D 43/0231; B65D 43/06; B65D 47/10; B65D 2547/063
See application file for complete search history.

(56) References Cited

U.S. PATENT DOCUMENTS 4,361,249 A 11/1982 Tuneski et al.
6,991,128 B1 1/2006 Russo et al.
7,530,466 B2 5/2009 Spinelli et al.
7,691,302 B2 * 4/2010 Hollis ..... B65D 47/0847 264/154
7,819,271 B2 * 10/2010 Hollis ..... B65D 47/10 220/254.5
7,959,029 B2 6/2011 Whitaker et al.
D649,878 S 12/2011 Weiss
8,430,268 B2 4/2013 Weiss et al.
8,727,163 B2 5/2014 Chrisman
8,770,435 B2 7/2014 Weiss
2003/0218017 A1 * 11/2003 Schmidtner ..... B65D 43/0222 220/254.5
2004/0178207 A1 9/2004 Kim
2004/0200849 A1 10/2004 Goeking et al.
2005/0051552 A1 3/2005 Kim
2006/0071008 A1 4/2006 Sadlier
2006/0226148 A1 * 10/2006 Hundley ..... B65D 51/245 220/254.3
2007/0045316 A1 3/2007 Amljots
2014/0251996 A1 9/2014 Chrisman

* cited by examiner

*Primary Examiner* — Shawn M Braden
(74) *Attorney, Agent, or Firm* — Fay Sharpe LLP

(57) ABSTRACT

The present invention is directed to a lid for use on a drinking container. The lid is capable of being releasably sealably engaged with a top end of the container. The lid can be secured to the container in a manner to resist displacement of the lid if the container is dropped or tipped. The lid includes a tab portion, which is capable of being depressed by a user's mouth, tongue or lip so as to provide an opening in the lid. The tab portion is also biased so as to return to a closed position to close the opening upon removal of pressure against the tab portion. The tab portion can have a perimeter larger in at least one dimension than the opening to resist fluid discharge when in the closed position.

16 Claims, 10 Drawing Sheets

M1
M2
E
L
P
E'
S'
E''
S''
F'
F
G
T
200
190
185
150
140
163
220
210
220
120

DISPOSABLE BEVERAGE LID

This application claims the benefit of U.S. Provisional Application No. 62/575,661, filed Oct. 23, 2017, the disclosure of which is herein incorporated by reference.

BACKGROUND

The present exemplary embodiment relates to a disposable beverage lid. It finds particular application in conjunction with paper or plastic cups, and will be described with particular reference thereto. However, it is to be appreciated that the present exemplary embodiment is also amenable to other like applications.

It is well known to apply disposable lids to drinking cups for carry out sales of beverages, such as coffee. Such lids keep the liquid drink in the cup and prevent heat loss to the surrounding environment. Many commonly used lids have a small drinking hole formed in the top surface so the user can drink from the cup without removing the lid. The hole is made relatively small to inhibit accidental splashing or spilling of the liquid through the drinking opening. Of course, a tipped container will generally still spill through the drinking hole.

Conventional lids with drinking holes have to strike a balance between spillage and drinking flow. As the hole is made smaller, the amount of spillage prevented by the lid increases, but the amount of liquid flow through the hole as the user takes a drink decreases. Thus, by reducing the size of the hole, spillage is reduced at the expense of drinking flow. If the hole is too small, a comfortable amount of drinking flow cannot be achieved. If the hole is made larger to achieve better drinking flow, more liquid can accidentally spill or splash out through the enlarged hole.

Because of the tradeoff between spillage prevention and drinking flow, prior art lid designs simply cannot provide adequate spillage prevention, while still providing adequate drinking flow when the user tips the cup for a drink. There is a need for a lid design that improves spillage protection without compromising the desired drinking flow rate through the lid. The present disclosure provides an improved lid having excellent spill prevention and drinking flow.

A further element of importance in disposable lid design is the attachment mechanism between lid and cup. In general, lids known in the art include an annular outer rim that fastens over the brim of a container. Prior art lids have not generally proven satisfactory in staying attached if a full container is lifted by the lid or if dropped. The gap or tolerance between the circumferential rim of the lid and brim of the container will likely cause the lid to become completely dislodged from the container in the event a user accidentally spills the container, resulting in spillage of the contents therein.

Lids known in the prior art may not achieve a satisfactory sealing. Moreover, the opening through which the beverage is discharged to the user and any gap or tolerance between the circumferential rim of the lid and brim of the container will result in a leak if the container is knocked over. Similarly, the lid could become completely dislodged from the container. The present disclosure is directed to a self-sealing drinking passage and an improved seal between the lid and the container which reduces the likelihood of spillage if the container is tipped or dropped.

BRIEF DESCRIPTION

Various details of the present disclosure are hereinafter summarized to provide a basic understanding. This summary is not an extensive overview of the disclosure and is neither intended to identify certain elements of the disclosure, nor to delineate scope thereof. Rather, the primary purpose of this summary is to present some concepts of the disclosure in a simplified form prior to the more detailed description that is presented hereinafter.

The present invention is directed to a lid for use on a drinking container. The lid is capable of being releasably sealably engaged with a top end of the container. The lid includes a tab portion, which is capable of being depressed by a user's mouth, tongue or lip so as to provide an opening in the lid. The tab portion is also biased so as to return to a closed position to seal the opening upon removal of pressure against the tab portion.

According to another embodiment, a disposable beverage cup lid is provided. The lid includes a first section adapted to be mounted on a beverage cup in peripheral sealing engagement with the rim of the cup and a second section which is sealed peripherally to the lower section and overlies the cup opening. An opening is provided in the second section through which a person can drink a beverage from the cup. A tab member is mounted in association with the opening for movement between open and closed positions relative to the opening in the second section. The tab member is biased to a closed position and operable by the lip of a person drinking from the cup for moving the tab member between the closed and open positions. The tab member is at least coextensive in dimension with the opening and includes at least one edge dimensioned wider than said opening. In certain embodiments, each edge of the tab is dimensioned greater than the opening. Advantageously, the self-sealing tab member can minimize or eliminate the spillage of container contends should the beverage container be tipped over.

According to a further embodiment, a lid for use on a drinking container is provided. The lid is capable of being releasably sealably engaged with a top end of the container. The lid includes a tab portion capable of being depressed so as to provide an opening in the lid. The tab portion is biased so as to return to a closed position upon removal of pressure against the tab portion. The tab portion is disposed on a wall oriented at >5° or >10° relative to a base wall forming a reservoir.

According to an additional embodiment, a method of forming a lid for use on a drinking container is provided. The lid has a plastic disk shaped body including a tab projection and a channel surrounding at least a portion of the tab projection. A slit is cut in the channel to form an opening adjacent a front edge and a substantial length of the side edges of the tab.

According to an alternative embodiment, a lid for a container is provided. The lid comprises a closure having a disk shape and a circumferential rim extending about a periphery of the closure. The circumferential rim includes an annular inner side wall and an annular outer side wall. The outer side wall extends around the inner side wall and is general opposite to the inner side wall. The outer side wall and inner side wall are interconnected by an annular top wall. The combination of the annular inner side wall, the annular outer side wall, and the annular top wall define a channel. The inner side wall extends below the outer side wall. The outer wall is formed at an angle generally complimentary to a wall of the container and the inner wall is formed at an angle contrary to the wall of the container.

BRIEF DESCRIPTION OF THE DRAWINGS

The invention consists in the novel parts, construction, arrangements, combinations and improvements, shown and described. The accompanying drawings, which are incorporated in and constitute a part of the specification illustrate one embodiment of the invention and together with the description, serve to explain the principles of the invention.

DETAILED DESCRIPTION

Reference will now be made in detail to several embodiments of the present beverage container lid assembly, examples of which are illustrated in the accompanying drawings. While the invention will be described in connection with these embodiments, it will be understood that it is not intended to limit the invention to that embodiment. On the contrary, it is intended to cover all alternatives, modifications, and equivalents as may be included within the spirit and scope of the invention defined by the appended claims. As used herein, substantially is intended to include greater than 66%.

It is contemplated that the teaching of the description set forth below is applicable to all types of packaging, including but not limited to, disposable beverage cup containers made from styrofoam, compostable plastic or polymer material, thermoplastic, paper for coffee, tea, soda or other suitable material, as is readily appreciated by one skilled in the art. The present disclosure is therefore not intended to be limited to any particular container apparatus or configuration described in the exemplary embodiments of the present disclosure. It should be appreciated that the present invention may also be applicable to other types of containers, including but not limited to non-disposable containers, such as, for example, a vacuum sealed travel coffee cup, and food storage containers.

Figure 1:
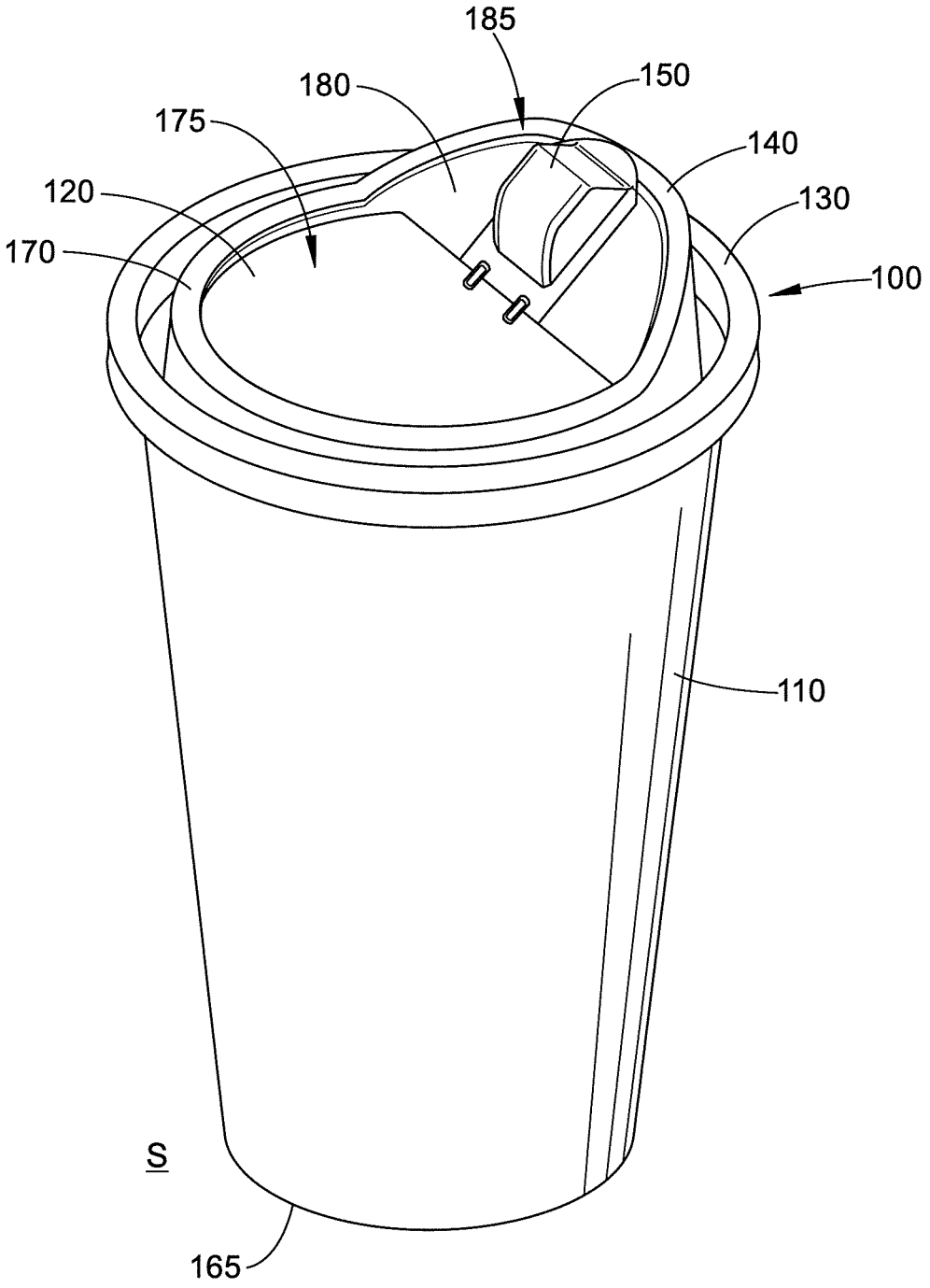
FIG. 1 is a perspective view of a beverage container and lid of the present disclosure.

As shown in FIG. 1, a beverage container assembly 100 may include a container 110, such as a cup, having an opening configured to receive a lid 120. Containers 110 are well known to those of ordinary skill in the art and various conventional disposable or reusable containers may be suitable. By way of example and not limitation, the container 110 may comprise a conventional disposable coffee cup, insulated or not insulated, a conventional disposable soft-drink cup, such as those used in most fast-food restaurants, or another beverage container.

The lid 120 may be configured to receive a portion of the container 110 and to at least substantially enclose the opening of the container 110. For example, the lid 120 may include a channel 130 configured to engage a rim of the container 110 to form a seal around the opening of the container 110. The lid may also include a spout 140 with a tab member 150 closing an opening 185 in the spout (effectively a one-way valve). The spout 140 can be inclined upwardly from a generally horizontal surface 160 (horizontal when container 110 is resting on a surface 5 at its base 165).

A rim 170 can cooperate with the spout 140 to surround the surface 160 and form a catch basin 175. In certain embodiment, the rim 170 will encompass the surface 160 and the periphery of spout 140. In certain embodiments the rim 170 will have a lesser height adjacent to opening 185 than adjacent to basin 175. For example, the height of rim 170 can generally change as it travels up inclined surface 180 such that the height of the rim at the most elevated point on the spout 140 is less than 20% of the height of the rim adjacent catch basin 175.

As shown in FIG. 3, the catch basin may include a vent hole 177. Spout 140 can be angled (inclined surface 180) at greater than 5° relative to surface 160, greater than 10°, or greater than 30°, but generally less than 70°.

Figures 2, 2A, 2B, 2C, 2D:
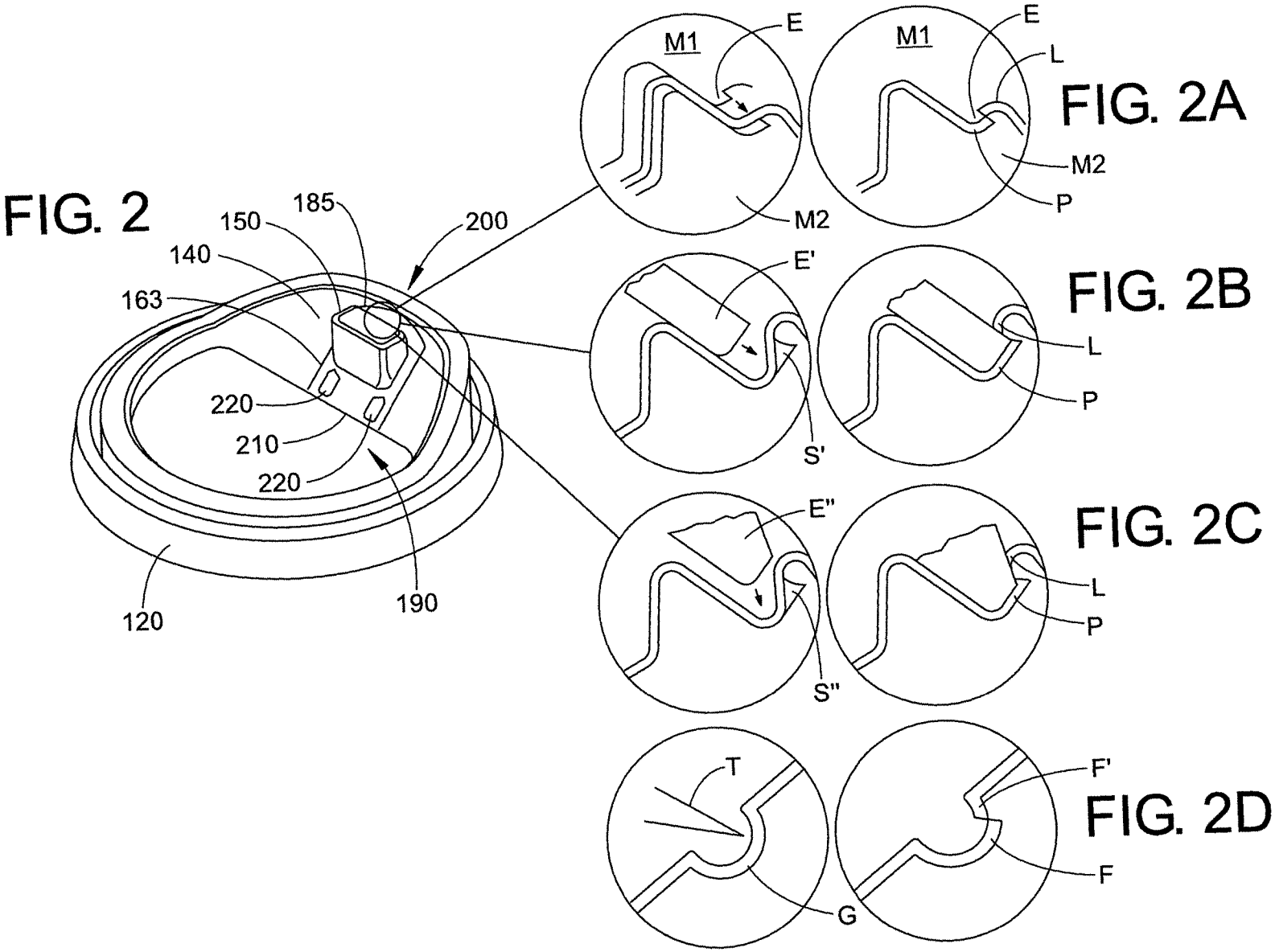
FIG. 2 is a perspective view of one embodiment of the beverage container lid.
FIGS. 2A-2D are exploded cross-section views of alternative mechanisms for cutting a tab slit that provides an overhang between the tab and the lid body.
Figure 3A:
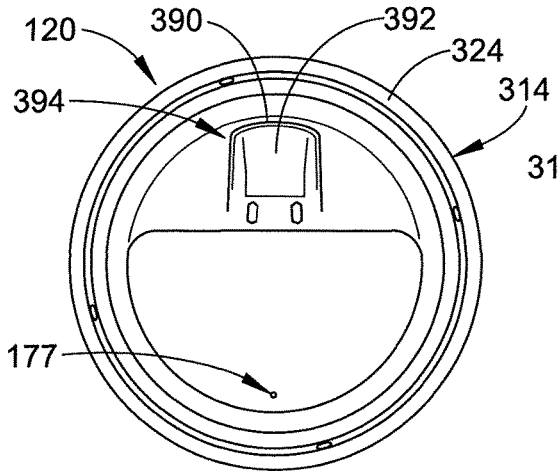
FIGS. 3A-3E are top plan, perspective, front side, right side and bottom views, respectively, of an exemplary container lid.
Figure 3B:
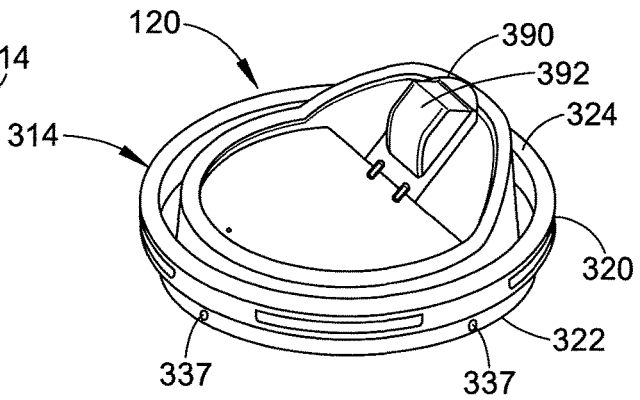
Figure 3C:
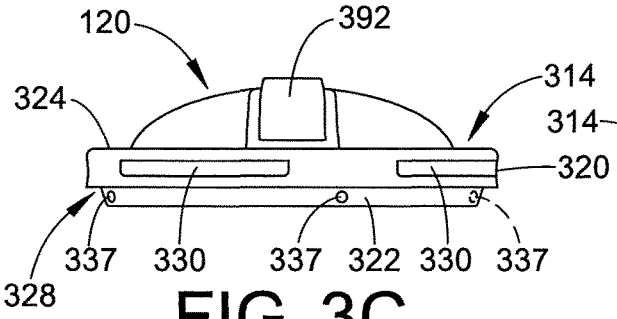
Figure 3D:
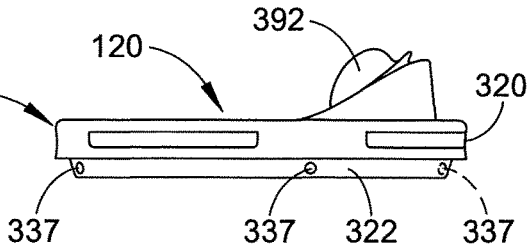
Figure 3E:
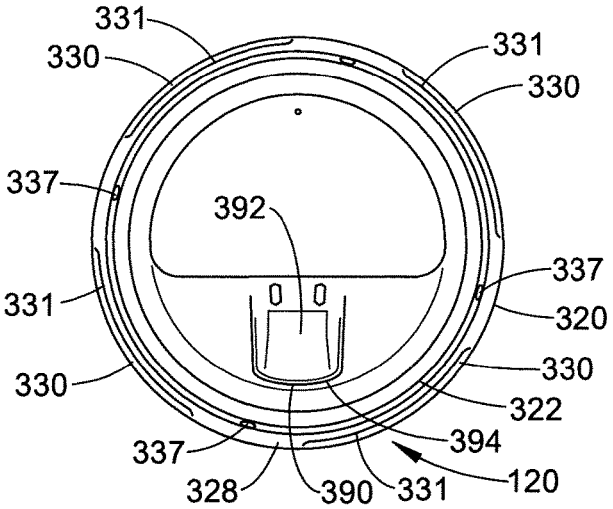
Figure 4B:
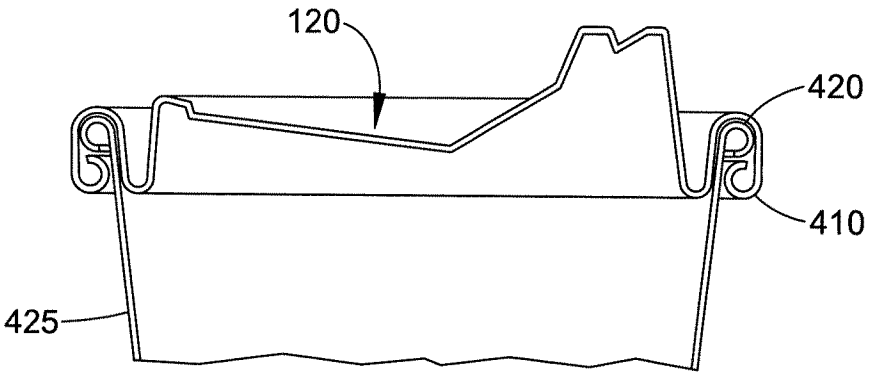
FIG. 4B is a cross-sectional view of the container lid engaged to the beverage container.
Figure 4C:
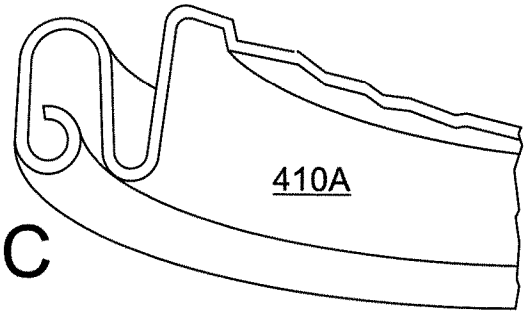
FIG. 4C is an exploded view of a full lid engagement edge and FIG. 4D is an exploded view of a notched lid engagement edge.
Figure 4D:
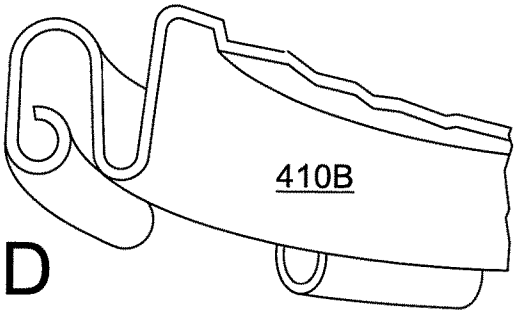
Figure 4A:
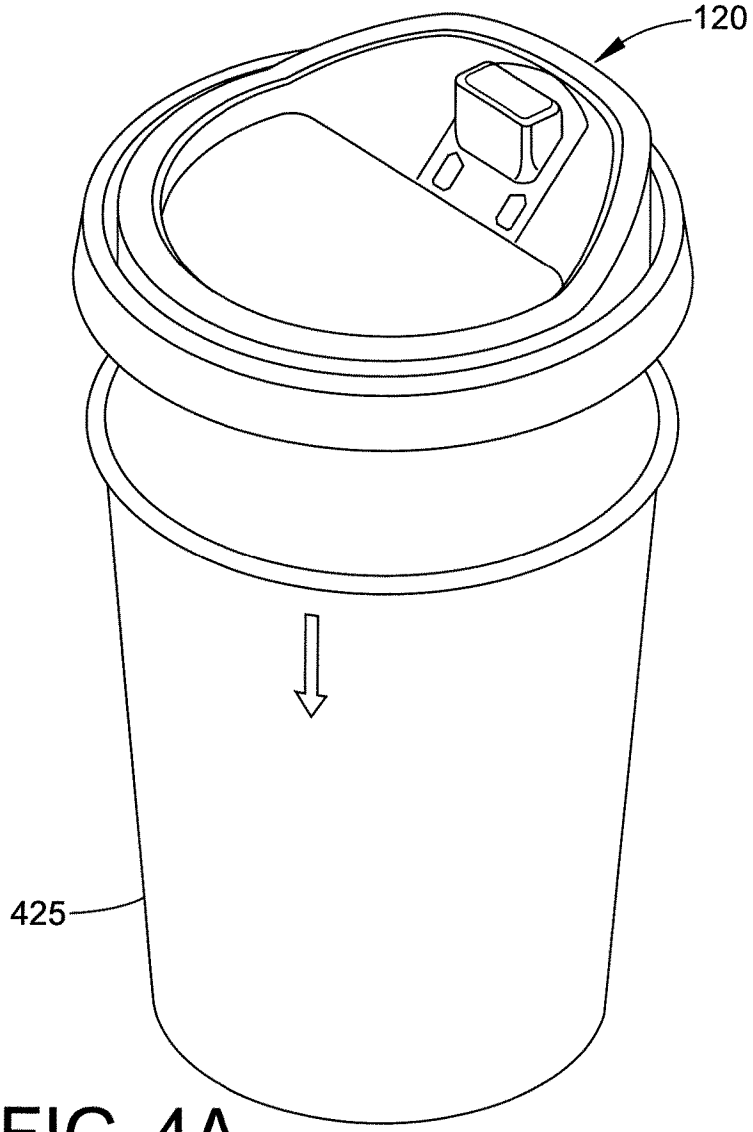
FIG. 4A is a perspective view of a container lid in association with a beverage container.

As illustrated in FIG. 2, the lid 120 includes an opening 185 on the inclined surface 180 at a top end of the spout 140. A tab member 150 (a valve flap) can close opening 185. The spout 140 may optically be defined by one or more sidewalls that extend downward from the opening 185 (i.e., from an upper surface of the lid 120). The spout 140 may be configured such that the first longitudinal end 190 may be relatively larger than the second longitudinal end 200. Additionally, the sidewalls of the spout 140 may be sloped at an angle of between about 1° and about 10° relative to vertical (i.e., vertical with respect to an orientation of the lid coupled to a cup resting on a level surface). In other words, the sidewalls may define a hollow chamber that is tapered from the first longitudinal end to the second longitudinal end. Alternatively, the spout 140 may comprise any suitable shape conducive to the flow of a fluid therethrough.

The opening 185 and tab member 150 may be positioned proximate to the second longitudinal end of the spout 140. The tab member 150 can be, at least substantially the same size and shape as the opening 185. In select embodiments, the tab member 150 is larger at its periphery than the opening 185. The spout 150 may be coupled to a portion of the spout 140 along at least one side 210 of the tab member 150. The one side 210 can include a channel or score line to facilitate flexing of the tab member 150 relative to the main body of lid 120. Gussets 220 comprised of inwardly or outwardly configured indentations can be provided to bias tab member 150 into a closed position. The remaining sides of the tab member 150 may be separated from the wall of the spout 140 (which has a general location indicated by line 163). In this regard, the one side 210 of the tab member 150 is coupled to the spout 140 to form a hinge 190 configured to enable the tab member 150 to rotate between a substantially closed position and an open position.

It is desirable that at least one edge of the tab member overlap the internal surface of the spout wall. In certain embodiments, it is desirable that all free outer edges of the tab member engage an interior surface of the spout wall (i.e. the cup facing portion of inclined surface 180) the tab member is in a closed position. In this manner, if the beverage container including the present lid configuration is tipped over, the tab member edges which overlap the spout wall adjacent the opening will prevent significant fluid leakage.

With reference to FIGS. 2A-2D, various mechanisms for achieving overlap of the periphery of the tab member with an inner surface of the container lid are displayed. In FIGS. 2A-2C, it is contemplated that a heated knife is used in the cutting step to provide elongation of the plastic material during cutting, yielding overlap of the finished product. More particularly, in FIG. 2A, an integral cutting element E is provided in association with mold halves M1 and M2. In this regard, element E trims portion P of the lid element and provides a small elongation thereof such that subsequent to molding/cutting portion P is inbound and overlapping with lid L. In FIGS. 2B and 2C alternative cutting elements E' and E" are employed post molding. In each embodiment, a backside space S' and S" is provided to allow the cutting element to displace a portion of the lid material and provide overlap between lid portion L and trim portion P.

Turning now to FIG. 2D, an alternative cutting technique is depicted wherein a groove G is first molded into the lid. A cut is then formed in groove G using a normal cutting tool T. After cutting, the natural tension in the plastic material results in the original groove dimension narrowing, providing overlap of the first side F with second side F'. It is noted that the groove and/or cut therein can extend from a distal radial edge and terminate radially outwardly from an inner edge of the tab. Moreover, by terminating the cut radially outwardly from the hinge portion (one side 210), the bias toward closed for the tab member can be increased.

As described in greater detail in the embodiment of FIGS. 7-10, the desired bias to closed for the tab member 15 can be increased by forming the region of the inclined surface upon which the tab member is formed as a planar surface projecting outwardly from the adjacent region of the inclined surface.

The preferred material of the lid is a flexible and deformable plastic material. The lid can be composed of recyclable material, such as PET, RPET, polypropylene, polystyrene, polyethylene, high impact polystyrene or other suitable material.

With reference to FIG. 3, the lid 120 includes a circumferential rim 314 comprised of an annular outer side wall 320, an annular inner side wall 322 and an annular top wall 324, which interconnects the annular outer side wall and the annular inner side wall. The annular outer side wall 320, the annular inner side wall 322 and the annular top wall 324 define a channel 328 for mating with the brim of a container. The annular outer side wall 320 is disposed opposite to the annular inner side wall 322 at a distance from the inner wall 322 and is contiguous to the top wall 324. The annular outer side wall 320 extends around the annular inner wall 322. The annular outer side wall 320 is generally parallel to and opposite the annular inner side wall 322. The channel 328 is sized to fit the rim of a container.

The annular outer side wall 320 can include annular rib elements 330. The annular rib elements 330 can have a generally convex profile relative to an inner surface of an inside wall of the container and provide a gripping force. A single continuous rib or multiple spaced ribs may be utilized.

In certain embodiments, the annular rib elements 330 can be formed to include at least one edge (e.g. edge 331) that is at least substantially a right angle or an acute angle. Moreover, it is believed that forming a sharper point of engagement between annular outer side wall 320 and the outer surface of the beverage container will improve strength of the lid attachment.

In certain embodiments, annular inner side wall 322 will extend further (for example at least 15% or 25% in length) from the primary plane of the lid 120, than annular outer side wall 320. Alternatively, the annular outer side wall 320 can extend a small distance (for example, less than 20% of the overall height of the lid) beyond the inner annular side wall 322. In either embodiment, it may be desirable for the annular rib elements 330 to be opposed (horizontally) by a portion of the inner annular side wall 322.

The annular outer side wall 320 can be formed at an angle generally complimentary to a wall of the container (e.g. follows the shape of the container wall) and the annual inner side 320 wall can be formed at an angle contrary to the wall of the container (e.g. forms an acute angle at the interface with the inner surface of the container wall), wherein the combination of the annular inner side wall and the annular outer side wall combine to pinch the container. The annular inner side wall 322 may also be provided with projections 337.

The inner annular wall can be less than ±5° or ±10° from perpendicular to the primary plane of the lid. The outer annular wall can have an angle that generally parallels the slant of the beverage container outer surface. This angle is often greater than ±5° or ±10° from perpendicular to the lid plane. In other embodiments, the inner annular wall will have an angle relative to perpendicular to the primary plane of the lid which is less than the angle of the outer annular wall relative to perpendicular to the primary plane of the lid. In this aspect, the lid mates and seals with the cup in the vicinity of the brim in at least two different locations. Moreover, the annular outer wall and the annular inner wall pinch the cup wall. In this manner, the present design provides a unique leak prevention seal on the internal surface of the beverage container. One, or both of the annular outer and inner walls can further include a ridge configured for engaging the container wall.

In certain embodiments, the terminal extent 390 of tab member 392 is elongated radially outwardly. Moreover, the terminal extent 390 the tab member provides the furthest radial point which in its fully opened position engages the edge of the opening 394 formed in the spout surface. This can prevent the tab member from being displaced within the spout.

Figure 5:
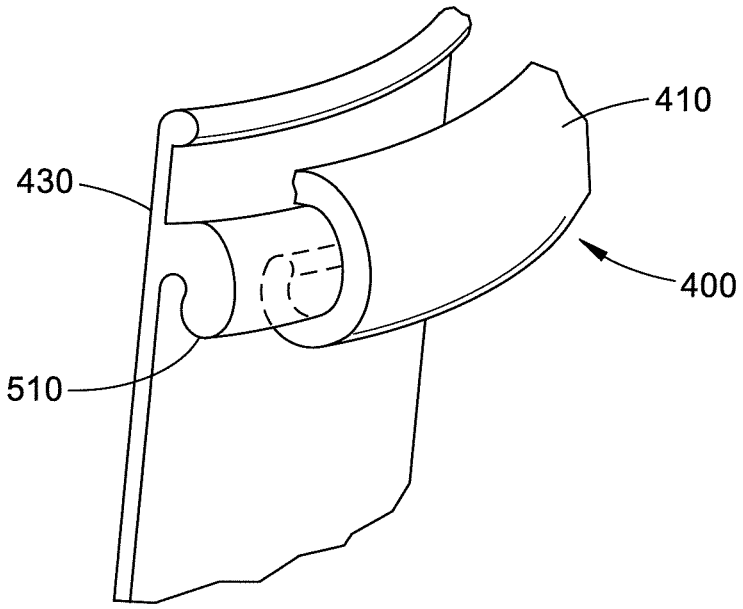
FIG. 5 is a perspective view of an alternative beverage container lid locking mechanism.

With reference to FIGS. 4 and 5, a lid 400 including an inwardly rolled edge 410 is provided. Advantageously, rolled edge 410 can interface with brim 420 present on the beverage container 425. This interface can provide a lid to beverage container attachment that will not be displaced if the container is tipped or dropped. In 410A, the rolled edge is continuous. However, the interface may be sufficiently strong to allow intermittent rolled edges on the lid (see 410B). This design with the internally sealed lid configuration of FIG. 3 can provide exceptional lid attachment and spill resistance. In the embodiment of FIG. 5, the beverage container 430 is provided with a separate locking shelf 510 which mates with the inwardly rolled edge 410 of the lid.

Figure 6B:
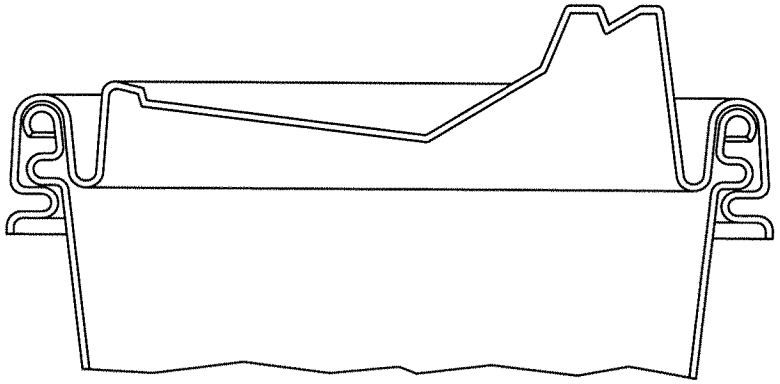
FIG. 6A is a perspective view and FIG. 6B is a cross-section view of a twist and lock mounting assembly including container configurations are illustrated in C1-C3 and various lid configurations in L1-L4.
Figure 6A:
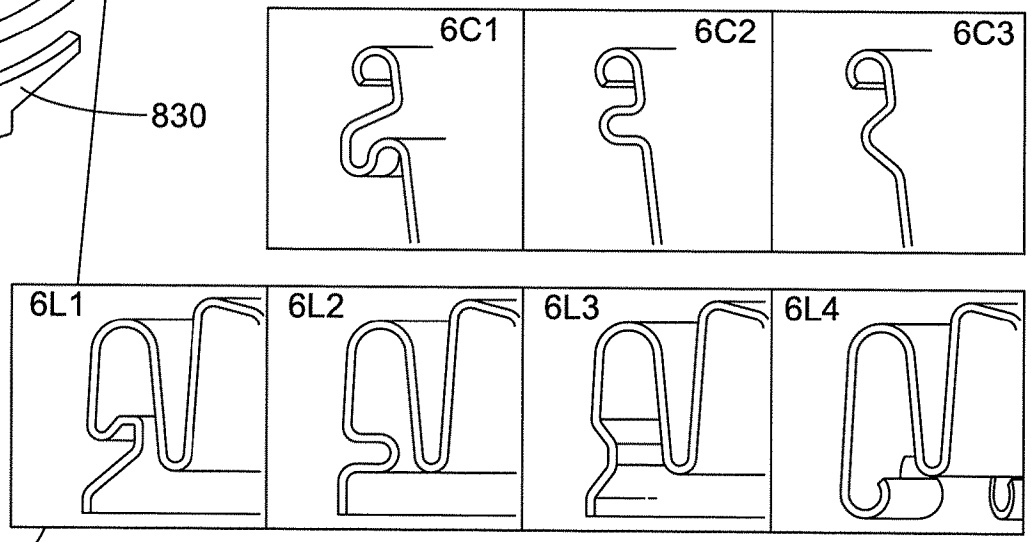
Figure 6A:
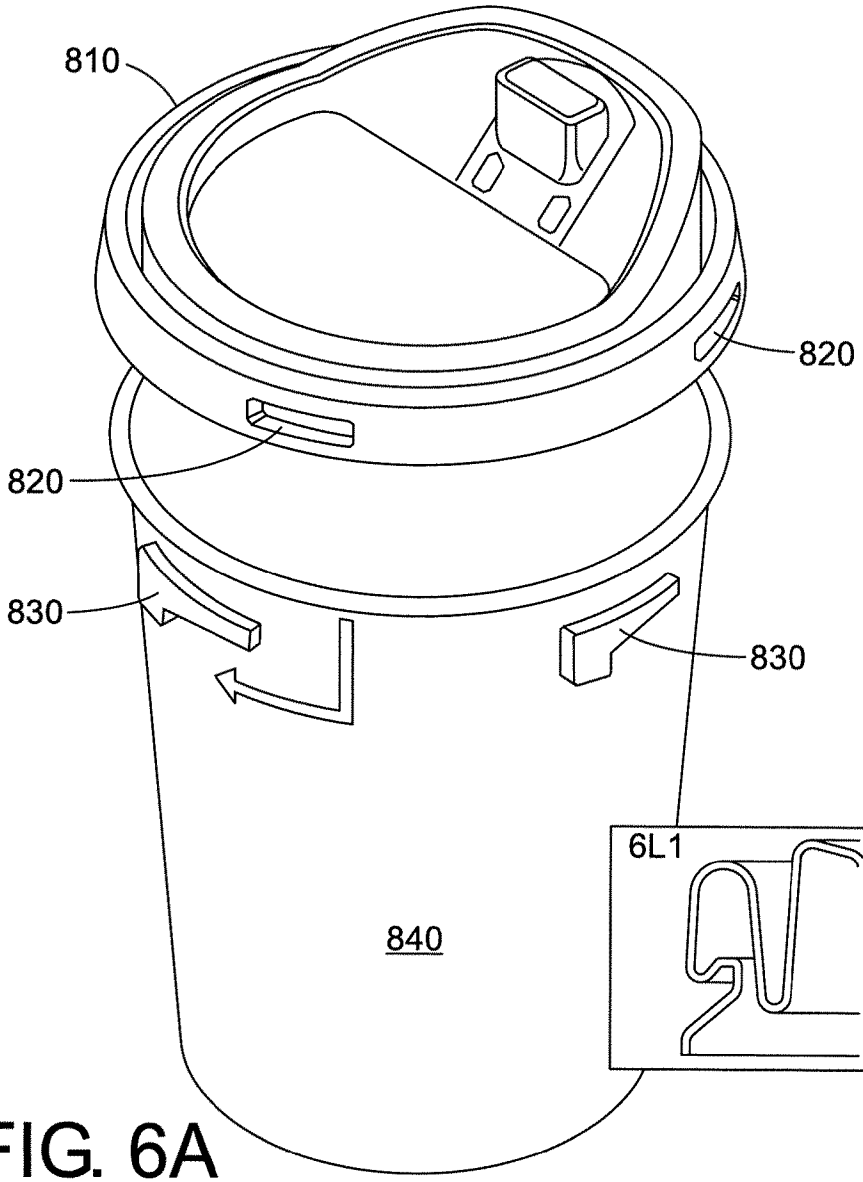
Figure 7B:
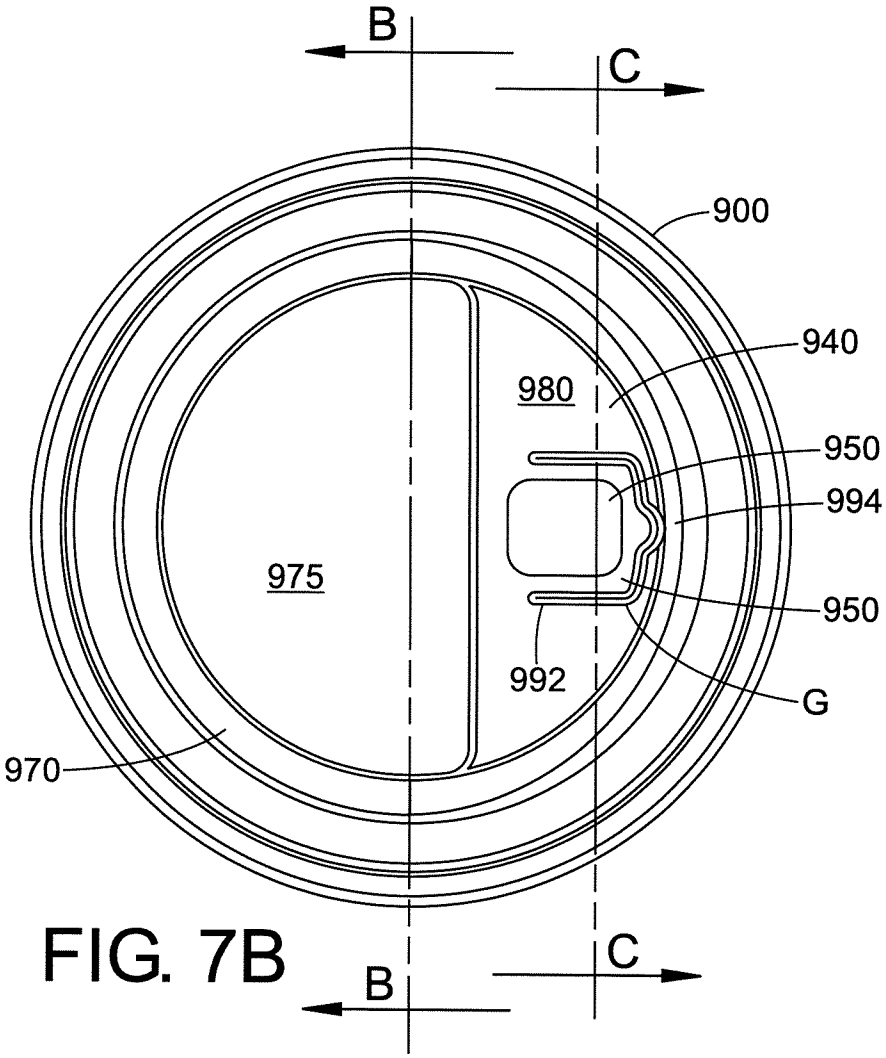
FIGS. 7A and 7B are different orientations of top plan views of an alternative disposable beverage cup lid embodiment.
Figure 7A:
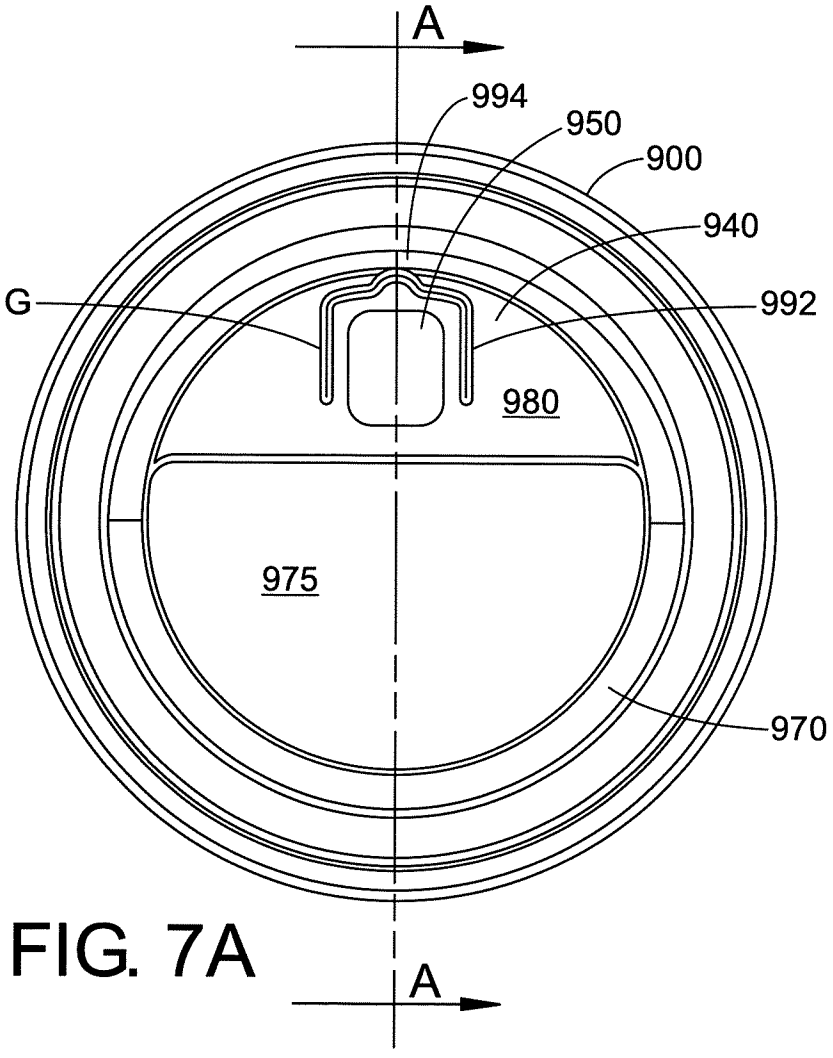
Figure 8:
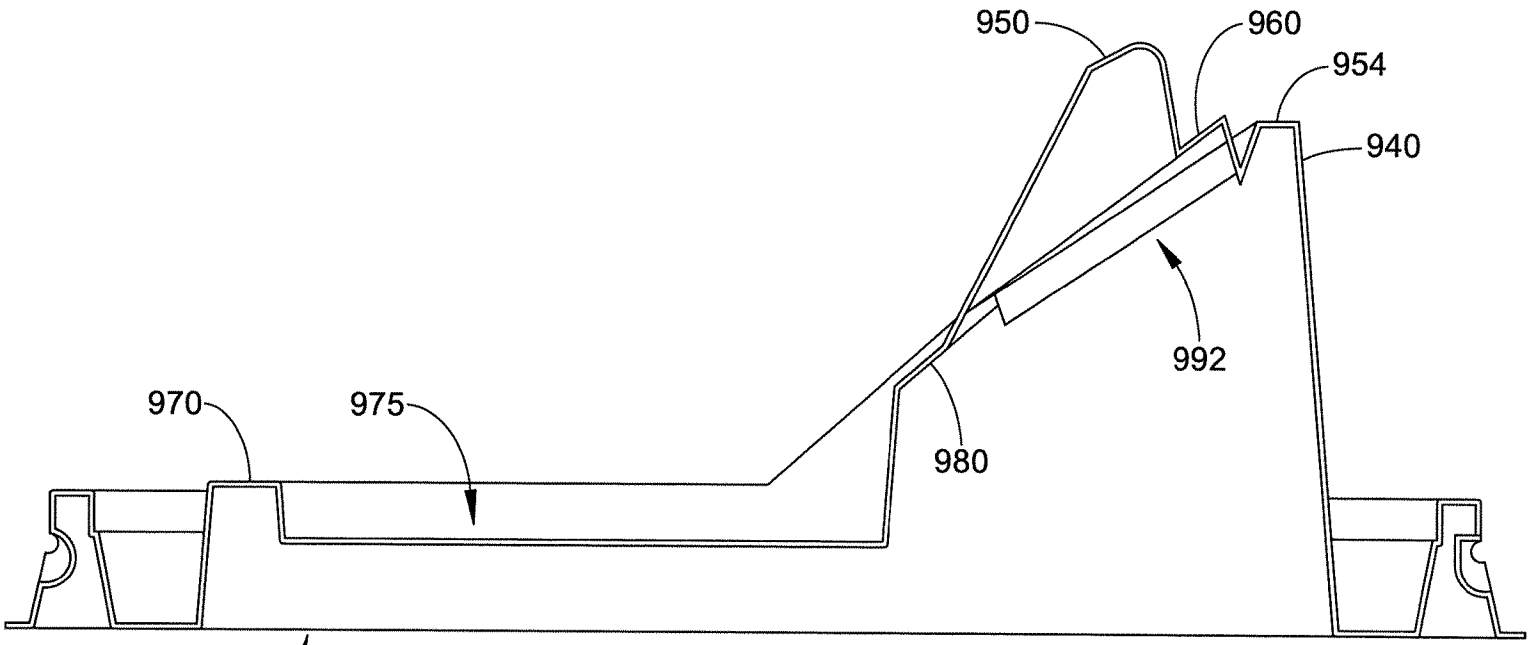
FIG. 8 is a cross-section view along line A-A of FIG. 7A.
Figure 9:
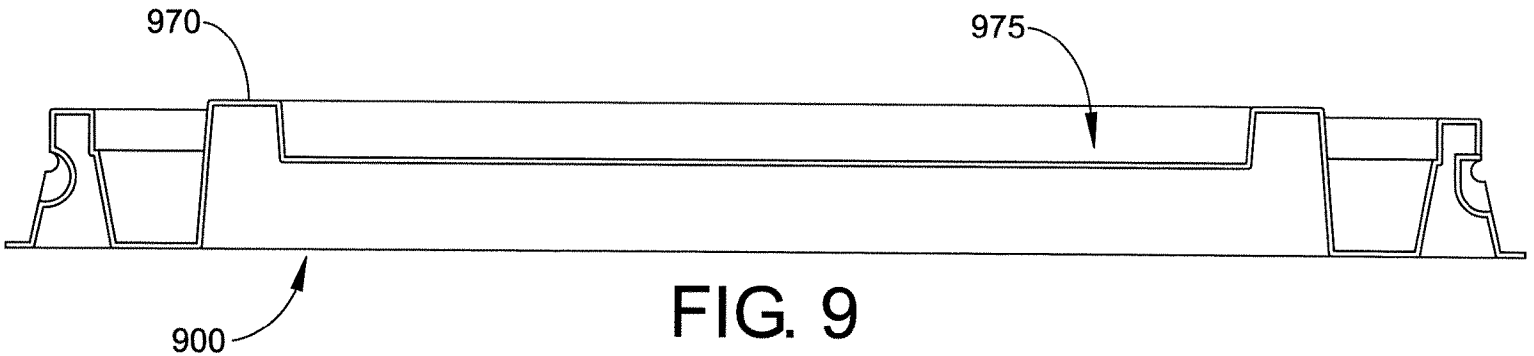
FIG. 9 is a cross-section view taken along line B-B of FIG. 7B.

Referring now to FIGS. 6A and B, a twist and lock mechanism of lid attachment to the beverage container is provided. Particularly, lid 810 is provided with spaced inward protrusions 820 to mate with locking elements 830 provided on an external surface of beverage container 840. Various contemplated locking element designs are depicted in FIGS. 61-63. Various inward protrusion configurations on the lid are depicted in FIGS. 61-64.

With reference now to FIGS. 7-10, an alternative disposable beverage cup lid 900 is depicted. In this configuration, a spout 940 is provided. Spout 940 can have a first height "h1" and a rim 970 forming drainage reservoir 975 can have a second height "h2", wherein h1 is at least two times h2, or at least three times h2 (see FIG. 11).

In addition, it may be advantageous to form tab member 950 in a region 960 of inclined surface 980 that is raised relative to the surround portion of inclined surface 980. More particularly, the raised portion 960 is raised during the lid molding process relative to surface 980. Accordingly, surface 960 is raised relative to surface 980 both before and after slitting groove G to form opening 992. The raised portion 960 can be defined by groove G in which the cut forming opening 992 is made. Moreover, at least a portion of the plastic material "inside" the groove can be elevated relative to at least a portion of the plastic material of the inclined surface outside and adjacent the groove. By forming portion 960 raised relative to surface 980 the tab member 950 is further biased into a closed position after slitting.

Figure 11:
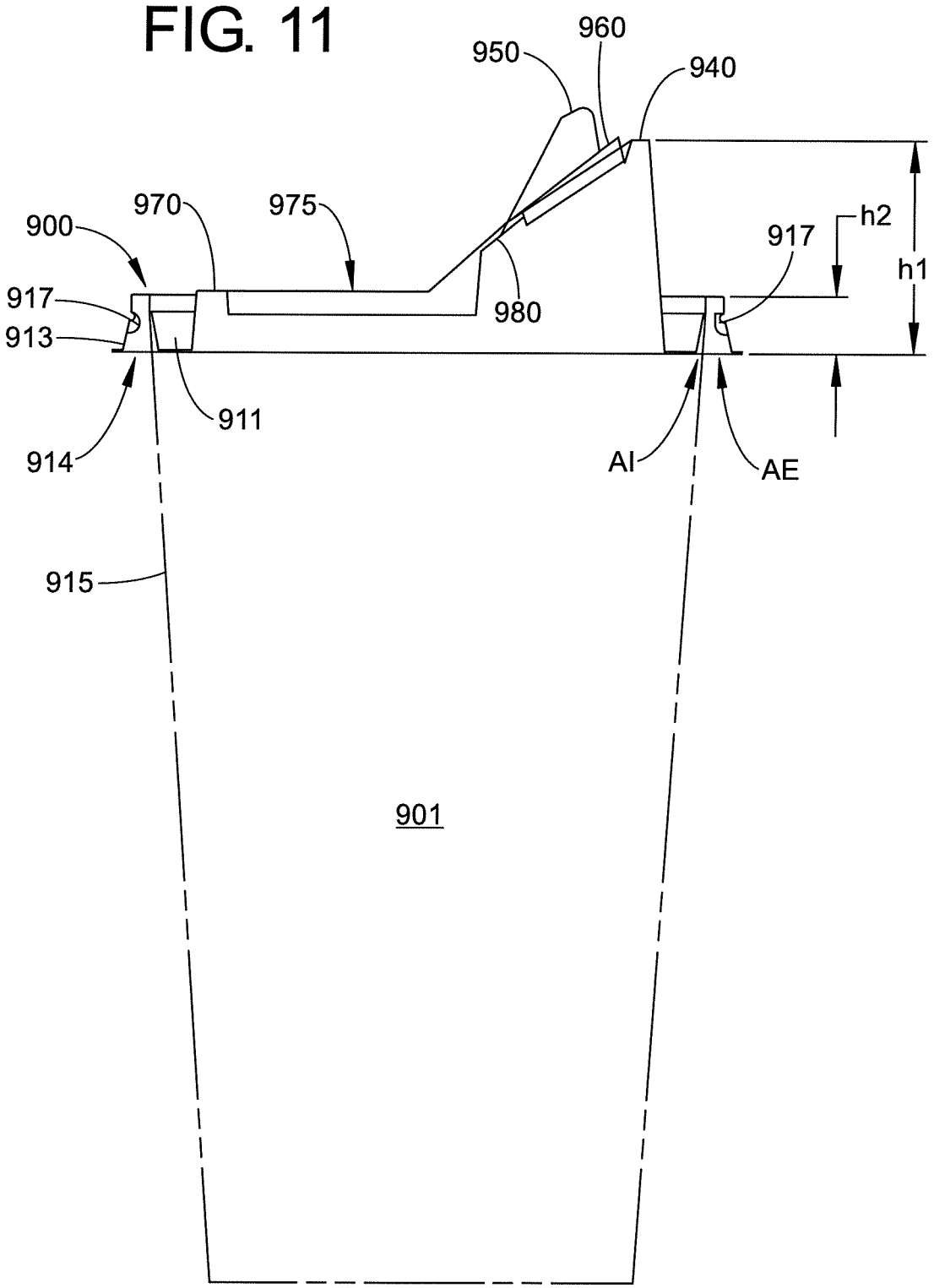
FIG. 11 is a side elevation view, partially in phantom, of the lid of FIG. 7 attached to a beverage cup.

With reference now to FIG. 11, the continuous internal sealing mechanism between lid 900 and container 901 is illustrated. More particularly, internal annular wall 911 and external annular wall 913 form channel 914 that receives container wall 915. Internal annular wall 911 is oriented at an angle "AI" which is relatively close to perpendicular (e.g. <5° or <10° from perpendicular). External annular wall 913 can be oriented at an angle "AE" further from perpendicular (e.g. >5° or >10°). Engagement between external annular wall 913 and container wall 915 can be enhanced via ridges 917. This configuration allows interior annular wall 911 to firmly and continuously engage the interior wall of container 901.

Figure 10:
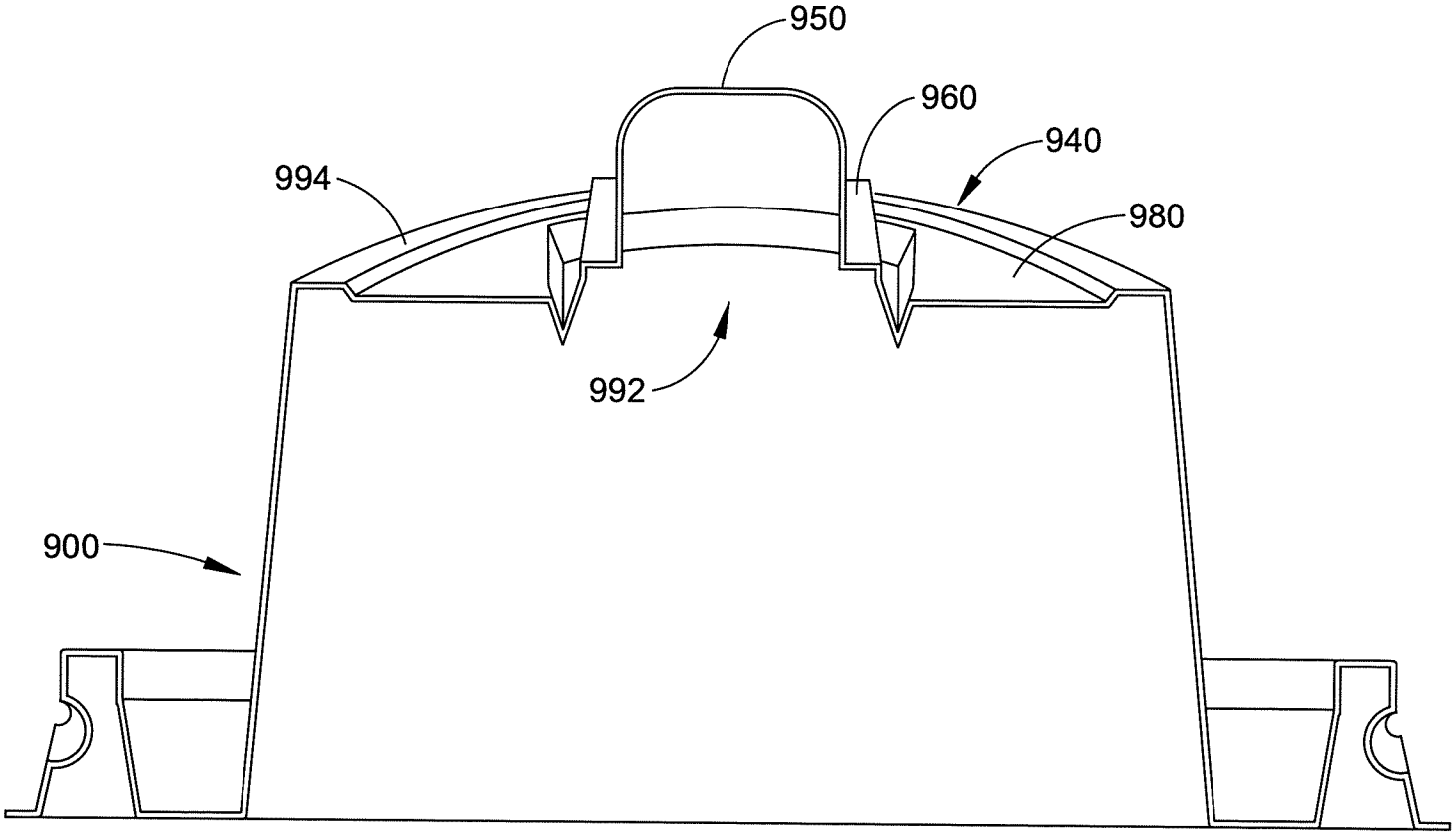
FIG. 10 is a cross-section view taken along line C-C of FIG. 7B.

In certain embodiments, the rim 994 in the spout 940 region which can be contiguous with rim 970 forming the drainage reservoir 975 will decrease in height as it approaches the tab 950 (see FIG. 10).

In certain embodiments, the tab is not integrally formed from the material of the lid body but secured to the lid body by a mounting assembly. For example, the tab can be formed of a compound having a Shore A durometer hardness less than the lid body. The mounting assembly can comprise at least one cooperative projection and recess on each of the tab and lid body.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A disposable beverage cup lid, comprising: a lower section adapted to be mounted on a beverage cup in peripheral sealing engagement with the rim of the cup, and an upper section which overlies and is sealed peripherally to the lower section, an opening in the upper section through which a person can drink a beverage from the cup, a tab member mounted on the upper section in association with the opening, said tab member being movable between open and closed positions relative to the opening, said tab member being defined by a cut in said lid, said cut being formed adjacent three sides of said tab, said cut being formed in a groove adjacent at least two sides of said tab, said tab member biased to a closed position and operable by the lip of a person drinking from the cup for moving the tab member between the closed and an open positions, wherein said tab member is at least coextensive in dimension with the opening and includes at least one edge dimensioned wider than said opening.

2. The lid of claim 1 wherein said groove is adjacent at least three sides of said tab.

3. The lid of claim 2 wherein said groove extends from a distal radial edge of said tab and terminates radially outwardly from an inner edge of said tab.

4. The lid of claim 1 wherein said cut at its most radial location includes a generally a U or V shape.

5. The lid of claim 1 further comprising at least one gusset disposed between said tab and a lid body.

6. The lid of claim 1 having a disk shape and a circumferential rim extending about a periphery; the circumferential rim further comprising an annular inner side wall, and an annular outer side wall, wherein the outer side wall extends around the inner side wall and is opposite to the inner side wall, the outer side wall and inner side wall being interconnected by an annular top wall, the annular top wall interconnecting the outer side wall to the inner side wall and wherein said inner side wall forms an acute angle where it engages said container and said outer side wall forms an angle greater than said inner side wall.

7. A disposable beverage cup lid comprising a lower section adapted to be mounted on a beverage cup in peripheral sealing engagement with the rim of the cup, and an upper section which overlies and is sealed peripherally to the lower section, an opening in the upper section through which a person can drink a beverage from the cup, a tab member mounted on the upper section in association with the opening, said tab member being movable between open and closed position relative to the opening, said tab member biased to a closed position and operable by the lip of a person drinking from the cup for moving the tab member between the closed and an open positions, wherein said tab member is at least coextensive in dimension with the opening and includes at least one edge dimensioned wider than said opening, and wherein said tab is formed of a compound having a Shore A durometer hardness less than a lid body.

8. A disposable beverage cup lid comprising a lower section adapted to be mounted on a beverage cup in peripheral sealing engagement with the rim of the cup, and an upper section which overlies and is sealed peripherally to the lower section, an opening in the upper section through which a person can drink a beverage from the cup, a tab member mounted on the upper section in association with the opening, said tab member being movable between open and closed positions relative to the opening, said tab member biased to closed position and operable by the lip of a person drinking from the cup for moving the tab member between the closed and an open positions, wherein said tab member is at least coextensive in dimension with the opening and includes at least one edge dimensioned wider than said opening, and wherein said tab member is located on an inclined surface of a spout, said spout extending above said lower section.

9. The lid of claim 8 further comprising a drainage reservoir formed by a rim disposed inwardly of the lower section adapted to be mounted on the beverage cup.

10. The lid of claim 8 wherein said rim is higher adjacent said drainage reservoir than on at least a portion of said inclined surface.

11. The lid of claim 9 wherein said spout has a height "h1" which is at least twice a height "h2" of said rim.

12. The lid of claim 1 wherein said tab includes a terminal end extending further radially outward than an outermost extent of the opening.

13. A lid for a container comprising: a closure having a disk shape and a circumferential rim extending about a periphery of the closure; the circumferential rim further comprising an annular inner side wall and an annular outer side wall, wherein the outer side wall extends around the inner side wall and is opposite to the inner side wall, the outer side wall and inner side wall being interconnected by an annular top wall, said inner side wall formed at an angle generally complimentary to a wall of the container and the outer side wall formed at an angle contrary to the wall of the container, wherein the combination of the inner side wall, the outer side wall and the top wall define a channel, wherein said outer side wall includes a plurality of ridges configured to engage an outer surface of the container wall, said closure further including a drainage reservoir defined by an internal rim, wherein each of the outer side wall and the inner side wall have a height greater than a depth of the drainage reservoir.

14. The lid of claim 13 wherein said inner side wall further includes a plurality of ridges configured for engaging an inner surface of said container wall.

15. The lid of claim 13 wherein said disk shape defines a plane and wherein said inner wall is less than ±10° from perpendicular to said plane.

16. The lid of claim 15 wherein said outer wall is greater than ±10° from perpendicular to said plane.

* * * * *